US011189129B2

(12) United States Patent
Oyama et al.

(10) Patent No.: US 11,189,129 B2
(45) Date of Patent: Nov. 30, 2021

(54) GAME SYSTEM, METHOD OF CONTROLLING GAME SYSTEM, AND RECORDING MEDIUM

(71) Applicant: Universal Entertainment Corporation, Tokyo (JP)

(72) Inventors: Masaki Oyama, Tokyo (JP); Toshikazu Jinnouchi, Tokyo (JP); Masamichi Miyara, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 179 days.

(21) Appl. No.: 16/504,631

(22) Filed: Jul. 8, 2019

(65) Prior Publication Data

US 2020/0013261 A1 Jan. 9, 2020

(30) Foreign Application Priority Data

Jul. 9, 2018 (JP) ..... JP2018-129741

(51) Int. Cl.
*G07F 17/32* (2006.01)
*G07F 17/34* (2006.01)

(52) U.S. Cl.
CPC ..... *G07F 17/3223* (2013.01); *G07F 17/3227* (2013.01); *G07F 17/34* (2013.01)

(58) Field of Classification Search
CPC ..... G07F 17/3223; A63F 2300/51
See application file for complete search history.

(56) References Cited

U.S. PATENT DOCUMENTS 9,811,770 B2 * 11/2017 Kawajiri ..... G06K 15/4055
2002/0052229 A1 * 5/2002 Halliburton ..... A63F 1/00 463/9

OTHER PUBLICATIONS

Ivo Adan and Jacques Resing, Queueing Theory, Feb. 14, 2001, Department of Mathematics and Computing Science Eindhoven University of Technology (Year: 2001).*
Christensson, Per. "Controller Card Definition." TechTerms. Sharpened Productions, 2006. Web. Feb. 6, 2020. <https://techterms.com/definition/controllercard>. (Year: 2006).*

* cited by examiner

*Primary Examiner* — James S. McClellan
(74) *Attorney, Agent, or Firm* — Simpson & Simpson, PLLC; S. Peter Konzel

(57) ABSTRACT

A game system includes: terminal devices on each of which a game is playable; and a server which is connected to the terminal devices in a communicable manner and manages game data used in the game played on the terminal devices, each of the terminal devices including a controller, and the controller being programmed to execute the processes of: executing the game in which an accumulable gaming value is increased or decreased in accordance with a result; and requesting the server to send the game data managed by the server, when an amount of increase of the gaming value as a result of the game is equal to or larger than a predetermined threshold.

22 Claims, 9 Drawing Sheets

FIG.5

TERMINAL EVENT INFORMATION TABLE

| EVENT | STATUS | ACQUIRED POINTS | PARTICIPANTS | CURRENT RANK | POOLED POINTS | REWARD INFORMATION | HIGH RANK INFORMATION |
|---|---|---|---|---|---|---|---|
| A | IN PROGRESS | 6890 | 32 | 7 | 65470 | 1ST:35%、2ND:15%、・・・ | 1ST:AAA,19030、・・・ |
| B | END | 2360 | 14 | 5 | 300 | 1ST:50%、2ND:25%、・・・ | 1ST:BBB,8350、・・・ |
| ・・・ | ・・・ | ・・・ | ・・・ | ・・・ | ・・・ | ・・・ | ・・・ |

FIG.6

UPDATE THRESHOLD TABLE

| ACCUMULATED VALUE RANGE | UPDATED REQUEST INTERVAL |
|---|---|
| 0-10,000 | 30MINUTES |
| 10,000-100,000 | 20MINUTES |
| 100,000-1,000,000 | 10MINUTES |
| 1,000,000-10,000,000 | 5MINUTES |
| 10,000,000 OR MORE | AT EACH END |

GAME SYSTEM, METHOD OF CONTROLLING GAME SYSTEM, AND RECORDING MEDIUM

CROSS-REFERENCE TO RELATED APPLICATION

This application is entitled to the benefit of Japanese Patent Application No. 2018-129741 filed on Jul. 9, 2018.

BACKGROUND OF THE INVENTION

1. Field of the Invention

The present invention relates to a game system, a method of controlling the game system, and a recording medium.

2. Description of Related Art

Conventionally, users are able to participate in a social network game by using their terminal devices such as smartphones. Each user is able to play one's own game in a social network game, and the progress or the like of the game of some of the other users is graspable. A terminal device sends a request of updating a corresponding set of game data managed by a server to the server, and sends a request of supplying another set of game data managed by the server to the server. As such, in the game system of the social network game, communications from the terminal devices to the server are frequently carried out.

In this connection, for example, Patent Literature 1 (Japanese Laid-Open Patent Publication No. 2004-000307) recites that a gaming terminal sends a game data request based on current date-time information and a date-time condition stored in a date-time condition storage unit. This restricts the sending of a game data request and prevents access concentration to the server.

BRIEF SUMMARY OF THE INVENTION

In a social network game, an event in which terminal devices participate during a limited period is typically held. In the event, a request of supplying game data is likely to be made frequently as compared to the normal time, because each user plays the game in competition with or in cooperation with other users.

In Patent Literature 1, however, because the terminal device sends a game data request based on the current date-time information and the date-time condition stored in the date-time condition storage unit, the game data may not be requested at a suitable timing and acquisition of necessary information may not be timely done when, for example, the time at which the user plays the event does not correspond to the date-time condition.

An object of the present invention is to provide a game system which makes it possible to acquire necessary information at a suitable timing without inducing access concentration to a server, a method of controlling the game system, and a recording medium.

A game system of the present invention includes: terminal devices on each of which a game is playable; and a server which is connected to the terminal devices in a communicable manner and manages game data used in the game played on the terminal devices, each of the terminal devices including a controller, and the controller being programmed to execute the processes of: executing the game in which an accumulable gaming value is increased or decreased in accordance with a result; and requesting the server to send the game data managed by the server, when an amount of increase of the gaming value as a result of the game is equal to or larger than a predetermined threshold.

According to the arrangement above, the terminal device requests the server to send game data when the gaming value increases at least by a predetermined threshold as a result of the executed game. With this arrangement, even when the game is executed on the terminal device, a request of sending game data is not made until a gaming value equal to or larger than the predetermined threshold is acquired. As a result, even when the game is executed on the plural terminal devices, it is less likely that many terminal devices request the sending of game data at the same time, and hence access concentration to the server is avoided and necessary information can be acquired at a suitable timing.

In the game system of the present invention, the controller is programmed to further execute the processes of: requesting update of the game data at predetermined intervals; and shortening each of the predetermined intervals as the accumulated gaming value is increased.

According to the arrangement above, the process of requesting the update of the game data is executed at predetermined intervals, and the predetermined interval is shortened as the amount of the gaming value accumulated in the terminal device is increased. With this arrangement, the larger the accumulated gaming value owned by the user is, the more frequently the game data of the server is updated. When the accumulated gaming value is large, the game state is likely to be changed in the upcoming game play. For this reason, the game data is properly updated by preferentially updating the game data of such a user.

In the game system of the present invention, the server may change a timing to respond to a request of sending the game data after a predetermined period elapses, in accordance with the number of requests of sending the game data from the terminal devices within the predetermined period.

According to this arrangement, a timing to respond to a request of sending game data after a predetermined period elapses is changed in accordance with the number of requests of sending game data within the predetermined period. With this arrangement, when the number of requests of sending game data is large, a timing to respond to a terminal device is delayed on the server side, with the result that the load on the server is reduced.

A method of controlling a game system of the present invention, which includes: terminal devices on each of which a game is playable; and a server which is connected to the terminal devices in a communicable manner and manages game data used in the game played on the terminal devices, includes the steps of causing each of the terminal devices to execute the game in which an accumulable gaming value is increased or decreased in accordance with a result; and causing each of the terminal devices to request the server to send the game data managed by the server, when an amount of increase of the gaming value as a result of the game is equal to or larger than a predetermined threshold.

According to the arrangement above, the terminal device requests the server to send game data when the gaming value increases at least by a predetermined threshold as a result of the executed game. With this arrangement, even when the game is executed on the terminal device, a request of sending game data is not made until a gaming value equal to or larger than the predetermined threshold is acquired. As a result, even when the game is executed on the plural terminal devices, it is less likely that many terminal devices request the sending of game data at the same time, and hence access concentration to the server is avoided and necessary information can be acquired at a suitable timing.

A recording medium of the present invention is a non-transitory computer readable medium storing a game program, the game program causing a computer including a processor and a memory to execute the processes of: executing a game in which an accumulable gaming value is increased or decreased in accordance with a result; and requesting a server to send game data managed by the server which is connected to the computer in a communicable manner, when an amount of increase of the gaming value as a result of the game is equal to or larger than a predetermined threshold.

According to the arrangement above, the computer requests the server to send game data when the gaming value increases at least by a predetermined threshold as a result of the executed game. With this arrangement, even when the game is executed on the computer, a request of sending game data is not made until a gaming value equal to or larger than the predetermined threshold is acquired. As a result, even when the game is executed on plural computers, it is less likely that many terminal devices request the sending of game data at the same time, and hence access concentration to the server is avoided and necessary information can be acquired at a suitable timing.

The present invention makes it possible to acquire necessary information at a suitable timing without inducing access concentration to a server.

BRIEF DESCRIPTION OF THE DRAWINGS

Other and further objects, features and advantages of the invention will appear more fully from the following description taken in connection with the accompanying drawings in which:

FIG. 5 illustrates a terminal event information table.

FIG. 6 illustrates an update threshold table.

DETAILED DESCRIPTION OF THE PREFERRED EMBODIMENT

A game system of one embodiment of the present invention will be described with reference to figures.

(Outline)

Figure 1:
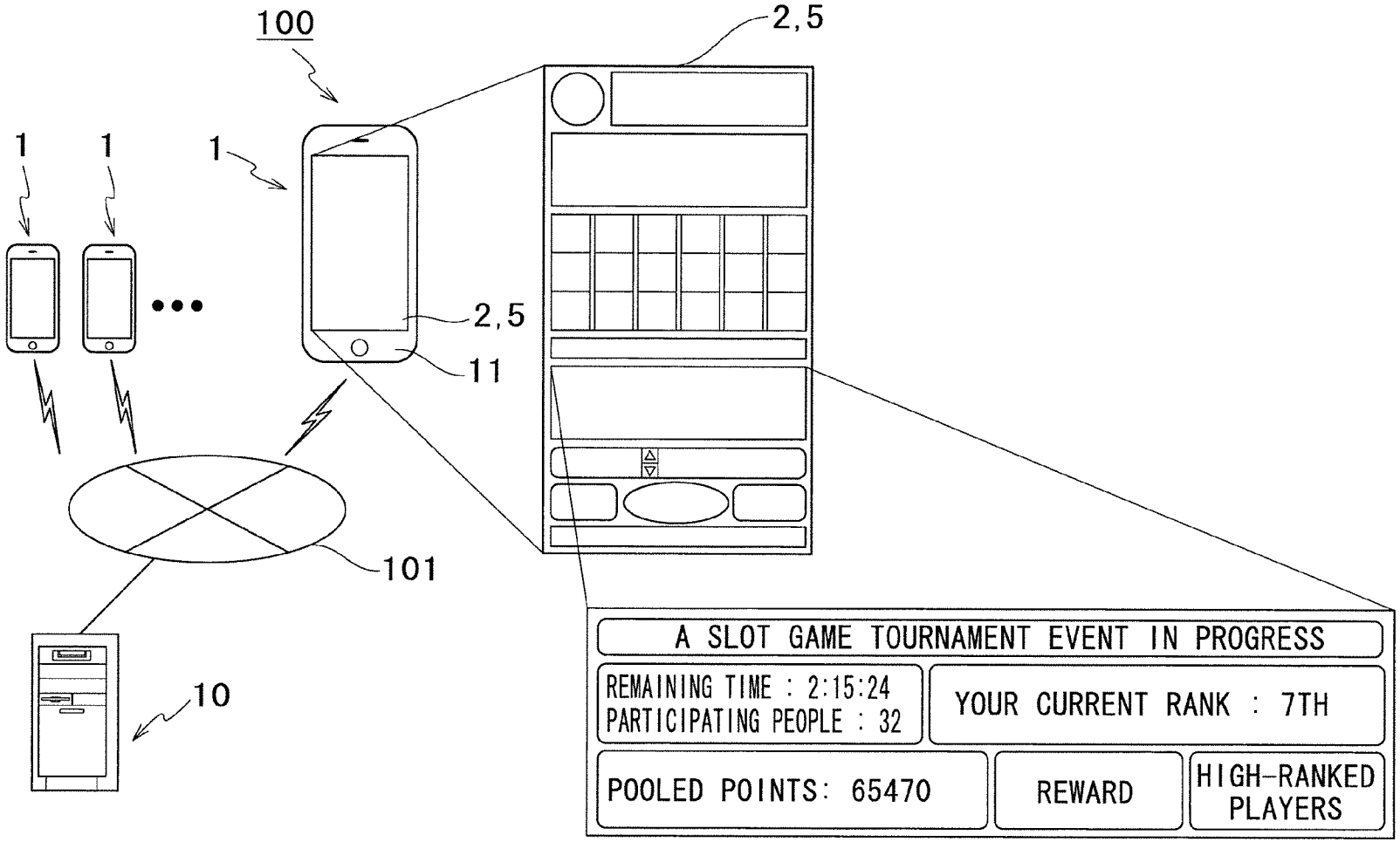
FIG. 1 illustrates the outline of a game system of one embodiment of the present invention.

As shown in FIG. 1, a game system 100 of one embodiment of the present invention includes terminal devices 1 and a server 10 connected to the terminal devices 1 over the internet 101 in a communicable manner. The terminal device 1 of the present embodiment is a so-called smartphone, and includes a display 2 provided on the front surface of a housing 11 and a touch panel 5 provided throughout the display 2. In the terminal devices 1, shared application software is installed from an application software server or the like corresponding to the OS (Operating System) of each terminal device 1. In the present embodiment, a slot game is playable as a game element of the application software installed in the terminal device 1. In other words, the user is allowed to play the slot game on this application software. The slot game may be an add-in of the application software. In other words, as an additional function of the application software, the slot game may be provided by an application software server, a server 10, etc. independently from the application software.

As detailed later, the slot game starts on the premise of consumption of an accumulable gaming value. When a winning is achieved as a result of the slot game, a gaming value corresponding to the type of the winning and the consumed gaming value is added to the accumulated gaming value. As such, the terminal device 1 executes the slot game in which the accumulable gaming value is increased or decreased in accordance with a result. The gaming value may be information (game point) which is used exclusively for starting the slot game and does not have a monetary value or may be electronic valuable information having a monetary value.

In the slot game of the present embodiment, an event is periodically held. The event is held for a predetermined period, and participating users compete for points acquired during the event. Points corresponding to the gaming value awarded in the slot game executed during the event are accumulated. The participating users are distributed to groups, and users in the same groups compete with one another.

As shown in FIG. 1, event information such as the ranking of each user and the names of highly-ranked users is displayable during the event. The event information is constituted based on game data stored in the server 10. The game data in the server 10 is updated based on update information sent from the terminal devices 1 participating in the event. After receiving event information based on the updated game data from the server 10, the terminal device 1 is able to display the event information on the display 2.

In the present embodiment, the terminal device 1 actively restricts the receiving of the event information described above, during the event in which the access from the terminal devices 1 to the server 10 is expected to be more concentrated than the usual. To put it differently, the terminal device 1 requests the server to send the event information when a result of the slot game executed during the event satisfies a predetermined condition. The predetermined condition is that the amount of increase of the gaming value as a result of the slot game is equal to or larger than a predetermined threshold.

As described above, the game system 100 of the present embodiment is a game system including the terminal devices 1 on each of which a game is playable and a server which is connected to the terminal devices 1 in a communicable manner and manages game data used in a slot game played on the terminal devices 1, and each of the terminal devices 1 is programmed to execute a process of executing the slot game in which the accumulable gaming value is increased or decreased in accordance with a result and a process of requesting the server 10 to send managed game data when the amount of increase of the gaming value as a result of the slot game is equal to or larger than a predetermined threshold.

As such, the terminal device 1 requests the server 10 to send game data (event information) when the gaming value is increased for at least the predetermined threshold as a result of the executed slot game. With this arrangement, even when the slot game is executed on the terminal device 1, a request of sending game data (event information) is not made until a gaming value equal to or larger than the predetermined threshold is acquired. As a result, even when the slot game is executed on the plural terminal devices 1, it is less likely that many terminal devices 1 request the sending of game data (event information) at the same time, and hence access concentration to the server 10 is avoided and necessary information can be acquired at a suitable timing.

While in the present embodiment the restriction of the receiving of the event information as described above is performed only during the event, the disclosure is not limited to this arrangement. For example, the receiving of information from the server may always be restricted. Meanwhile, during the event, the event information may be received not only when the predetermined condition is satisfied but also when, for example, the application software is activated as an exception.

(Mechanical Structure)

As described above, the terminal device 1 includes a display 2 provided on the front surface of a housing 11 and a touch panel 5 provided throughout the display 2. While the terminal device 1 is a smartphone in the present embodiment, the terminal device 1 may be a mobile device or a desktop device. Examples of the terminal device 1 include mobile information devices such as a portable computer, a laptop computer, a tablet PC, a handheld PC, and a PDA (Personal Data Assistant).

The display 2 is configured to be able to display images. The display method of the display 2 is, for example, liquid crystal, organic electroluminescence, CRT (Cathode Ray Tube), or plasma. The touch panel 5 makes it possible to detect the coordinates of a part touched by a user's finger or the like. The touch panel 5 adopts an already known technology such as electromagnetic induction and electrostatic capacity. The terminal device 1 determines an object on the screen touched by the user, or the state of the touching such as swipe and the like based on coordinates detected by the touch panel 5. The terminal device 1 then makes a response according to the determination result.

The touch panel 5 may not be provided throughout the display 2. For example, the touch panel 5 may be provided on the back side of the housing 11, which is opposite to the display 2. Alternatively, the touch panel 5 may be provided at part of the display 2.

It should be noted that, where the display 2 is viewed from the front, a direction towards the lower end is referred to as "downward" or simply as "down", a direction towards the upper end is referred to as "upward" or simply as "up", a direction towards the left end is referred to as "leftward" or simply as "left", and a direction towards the right end is referred to as "rightward" or simply as "right", in the following description.

Further, in the following description, the expression reading selection or touch input by the user with respect to an object means the terminal device 1 determines that an object is selected in relation to the user operation received by the touch panel 5.

Further, in the present embodiment, the touch panel 5 operates as an input device, and accepts a swipe input, a touch input, and the like; however, the present embodiment is not limited to this. For example, a microphone or a camera may be adopted as an input device, and may receive the user's voice or gesture as an instruction input.

(Electrical Structure)

Figure 2:
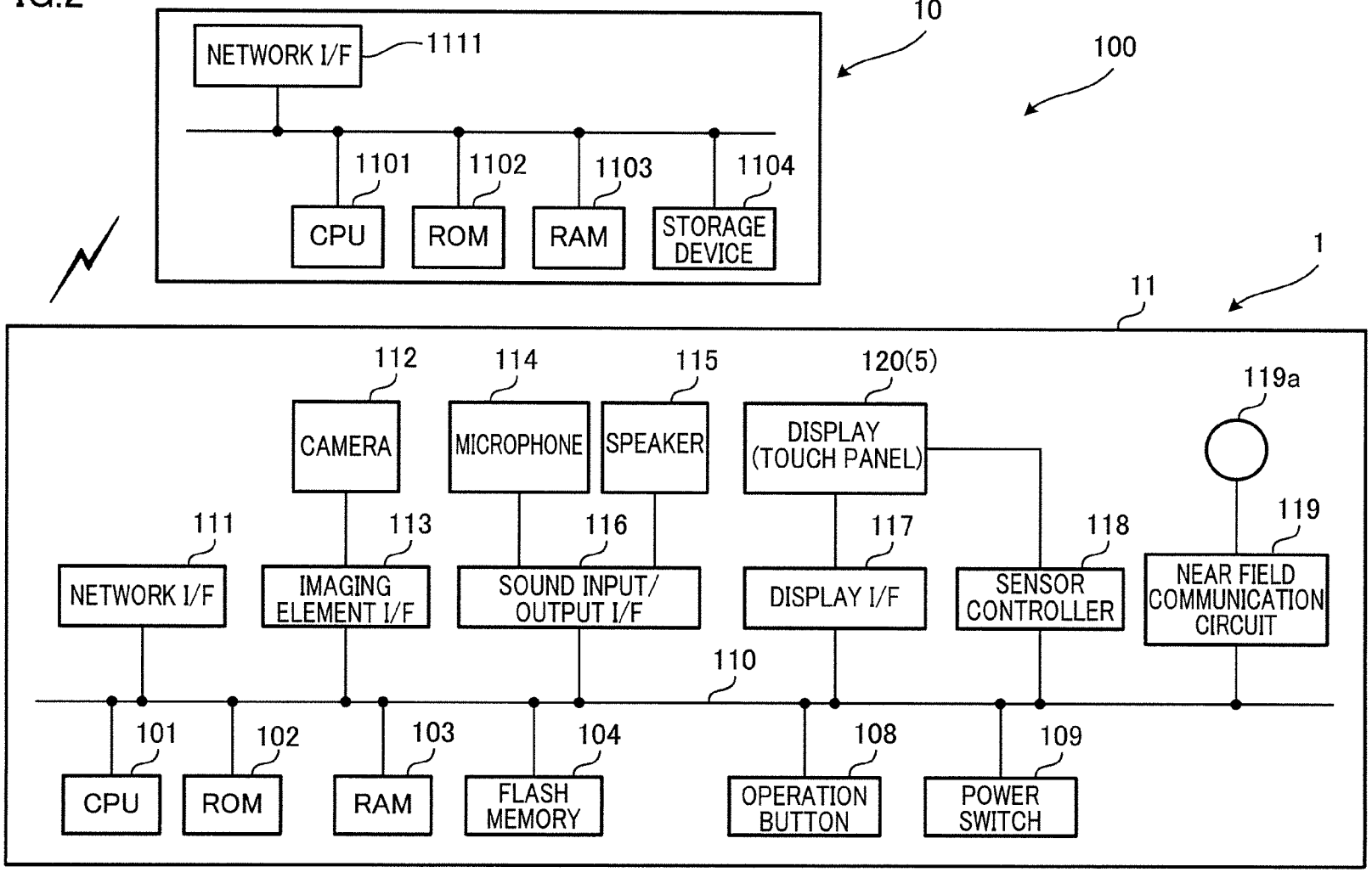
FIG. 2 is a block diagram of the electrical configuration of the game system shown in FIG. 1.

As shown in FIG. 2, the terminal device 1 includes, in the housing 11, a CPU 101, a ROM 102, a RAM 103, a flash memory 104, an operation button 108, a power switch 109, a bus line 110, a network I/F 111, a camera 112, an imaging element I/F 113, a microphone 114, a speaker 115, a sound input/output I/F 116, a display I/F 117, a sensor controller 118, a near field communication circuit 119, and an antenna 119*a* of the near field communication circuit 119.

Further, the server 10 is a so-called computer including a CPU 1101, a ROM 1102, a RAM 1103, a storage device 1104 such as a hard disk drive and the like, and a network I/F 1111.

The CPU (Central Processing Unit) 101 functions as a main structure of the controller in the terminal device 1, and controls the entire operation of the terminal device 1. The CPU 1101 functions as a main structure of the controller in the server 10, and controls the entire operation of the server 10. The CPUs 101 and 1101 therefore function as controllers which control the entire operation of the game system 100. The ROM (Read Only Memory) 102 stores programs used for driving the CPU 101, such as an IPL (Initial Program Loader).

The RAM (Random Access Memory) 103 and the RAM 1103 are used as a work area of the CPU 101 and the CPU 1101. The operation button 108 is used for, for example, initial setting of the terminal device 1. The power switch 109 is used for turning on/off the power source of the terminal device 1.

The flash memory 104 is a non-transitory computer readable medium which stores the game program, a program for communication, and plural sets of data such as image data and sound data. For example, the flash memory 104 stores various programs including a game program executed by the CPU 101 as a controller and various data used in the various programs. The game program causes the terminal device 1 which is a computer including the CPU 101 and the flash memory 104 to execute a process of executing the slot game in which the accumulable gaming value is increased or decreased in accordance with a result, and execute a process of requesting the server 10 to send managed game data when the amount of increase of the gaming value as a result of the slot game is equal to or large than the predetermined threshold. This realizes a method of controlling the game system, including the execution of the slot game in which the accumulable gaming value is increased and decreased in accordance with a result and the request for the server 10 to send game data when the amount of increase of the gaming value as a result of the slot game is equal to or larger than the predetermined threshold. As such, the processes and operations of the terminal device 1 can be interpreted as those of a game program or a game control method.

As described above, in the game system including the terminal devices 1 on each of which a game is playable and the server 10 which is connected to the terminal devices 1 in a communicable manner and manages game data used in a slot game played on the terminal devices 1, the following functions are realized: executing the slot game in which the accumulable gaming value is increased or decreased in accordance with a result; and requesting the server 10 to send managed game data when the amount of increase of the gaming value as a result of the slot game is equal to or larger than the predetermined threshold. While processes and operations described below presuppose that the terminal device 1 has these functions, the functions may be distributed to the terminal device 1 and the server 10. For example, random determination of a result of the slot game may be performed by the server 10.

The storage device 1104 is a non-transitory computer readable medium which functions as a database, and stores game data of each of the terminal devices 1. In response to a request from the game program in the terminal device 1, the server 10 returns as needed a response referring to the database in the storage device 1104.

The data and program in the flash memory 104 and the storage device 1104 may be stored in advance at the stage of factory shipment, or may be downloaded from an unillustrated server or the like via communication means and stored. The communication means may be an interactive communication passage such as the Internet and a cable TV, or may be one-way broadcasting. Alternatively, the data and program stored in the memory flash memory 104 and the storage device 1104 may be stored in a recording medium such as a floppy disk, a CD-ROM, a DVD-ROM, an MO (optical magnetic disc), and a flash memory, and may be read from the recording medium and installed in the memory according to need.

The network I/F (Interface) 111 and the network I/F 1111 are each an interface for data communications using a communication network such as the internet. The camera 112 is a built-in camera image capturing means which captures an image of an object to obtain image data under the control of the CPU 101. The imaging element I/F 113 is a circuit for controlling the camera 112. The microphone 114 is a built-in sound collection means to which sound is input. The sound input/output I/F 116 is a circuit for processing input and output of a sound signal between the microphone 114 and the speaker 115 under the control of the CPU 101. The display I/F 117 is a circuit for sending image data to the display 2 under the control of the CPU 101. The display 2 is provided on the front surface of the housing 11. The sensor controller 118 is a circuit for receiving an input from the touch panel 5 of the display 2. The near field communication circuit 119 is a communication circuit based on NFC (Near Field Communication) (Registered Trademark). Bluetooth (Registered Trademark), or the like. The bus line 110 is an address bus, a data bus, or the like for electrically connecting the components such as the CPU 101.

(Slot Game: Definitions)

The slot game is playable by a user as a game element of the installed application software. The slot game is a game in which symbols are varied and then stopped in a symbol display area (rearrangement) and a gaming value is awarded based on a combination of symbols displayed in the symbol display area. A state in which symbols are displayed after being varied and stopped in the symbol display area is termed "rearrangement". In the slot game, a bonus game advantageous for the player as compared to the normal game may be executed when the normal game is executed and a predetermined condition is satisfied in the normal game.

A gaming value is used as a substitute for credits in the game, and is used for betting as a condition to execute the slot game. That is, a user plays the slot game (unit game) once by betting a gaming value, and may acquire a gaming value as a result of the slot game.

The "unit game" is a series of operations from the start of the receiving of a bet to a state in which an award can be established. To put it differently, the unit game includes a single bet time for receiving a bet, a single game time of rearranging stopped symbols, and a single payout time of a payout process of awarding a payout.

(Slot Game: Functional Blocks)

Figure 3:
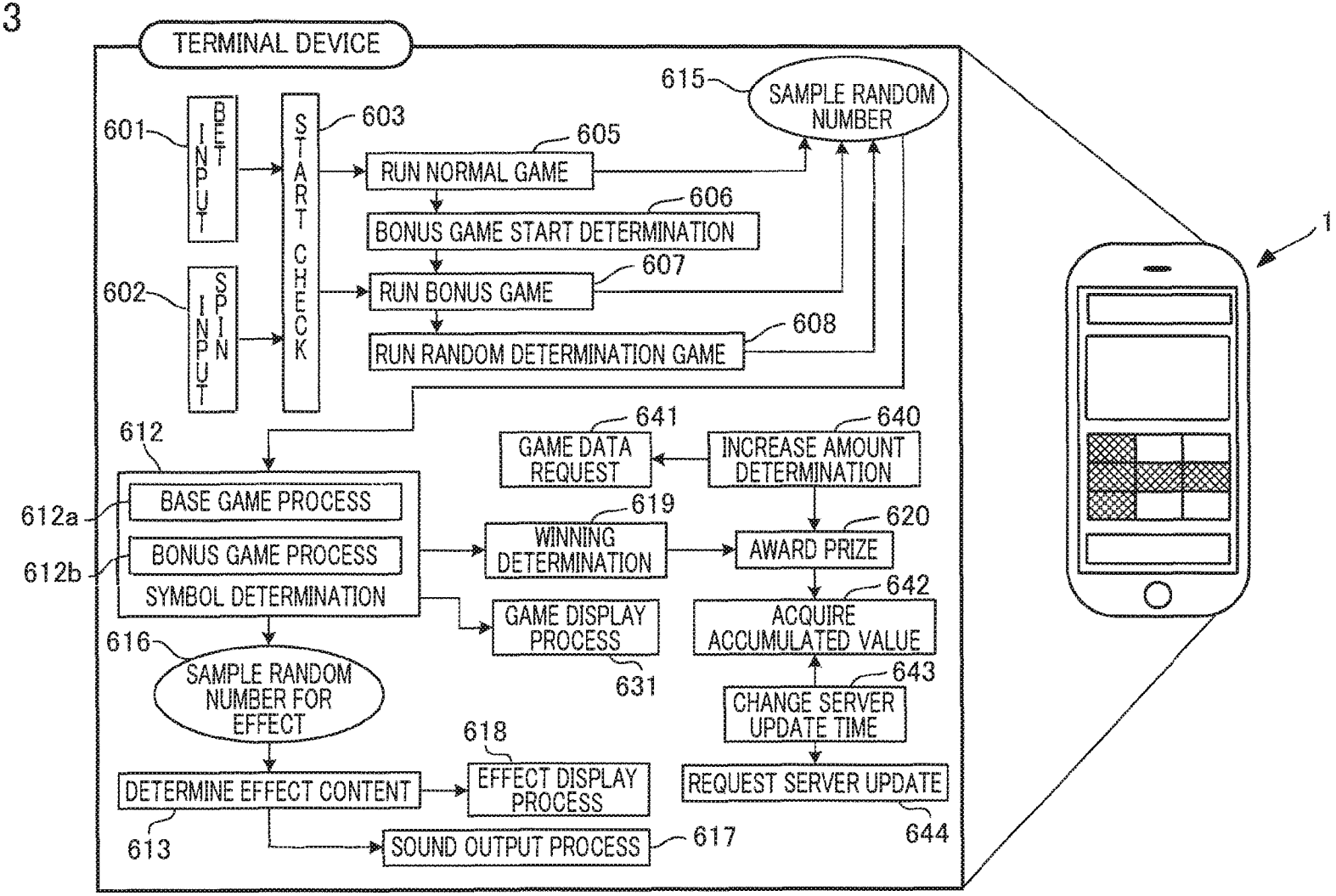
FIG. 3 is a functional block diagram of the game system shown in FIG. 1.

As shown in FIG. 3, the terminal device 1 which is a gaming machine running the slot game has the following functions. To be more specific, the terminal device 1 includes a BET input unit 601 and a spin input unit 602. The BET input unit 601 and the spin input unit 602 are kinds of input devices. The BET input unit 601 has a function of receiving a bet in response to a user operation. The spin input unit 602 has a function of receiving a user operation, i.e., an instruction to start a game.

The terminal device 1 includes a start check unit 603, a normal game running unit 605, a bonus game start determining unit 606, a bonus game running unit 607, a random determination game running unit 608, a random number sampling unit 615, a symbol determining unit 612, an effect-use random number sampling unit 616, an effect determining unit 613, a sound output unit 617, an effect display processing unit 618, a winning determining unit 619, a prize awarding unit 620, a game display processing unit 631, and a winning determination method determining unit 640.

The normal game running unit 605 has a function of running a normal game which is a base game, on condition that the BET input unit 601 is operated. The bonus game start determining unit 606 determines whether to run a bonus game, based on a combination of rearranged symbols resulted from the normal game. In other words, the bonus game start determining unit 606 has functions of: determining that the player is entitled to a bonus game when a bonus symbol is rearranged; and activating the bonus game running unit 607 so as to run a bonus game from the subsequent unit game. The random determination game running unit 608 has a function of randomly determining prizes including the bonus game. As this function is executed after the execution by the bonus game running unit 607, the bonus game can be repeatedly run.

The symbol determining unit 612 includes a base game processing unit 612*a* and a bonus game processing unit 612*b*. The symbol determining unit 612 including these processing units 612*a* and 612*b* has functions of: determining symbols to be rearranged based on a random number given from the random number sampling unit 615; rearranging the determined symbols in the game area 291 of the display 2; outputting rearrangement information of the symbols to the winning determining unit 619; and outputting an effect instruction signal to the effect-use random number sampling unit 616, based on the combination of the rearranged symbols.

The effect-use random number sampling unit 616 has functions of: when receiving the effect instruction signal from the symbol determining unit 612, extracting an effect-use random number; and outputting the effect-use random number to the effect determining unit 613. The effect content determining unit 613 has functions of: determining an effect content by using the effect-use random number; outputting image information on the determined effect content to the effect display processing unit 618; and outputting audio and illumination information of the determined effect content to the sound output unit 617.

The winning determining unit 619 has functions of: determining whether a winning is achieved based on a combination of symbols when rearrangement information of the symbols is given; calculating an amount of payout based on a winning combination formed when it is determined that a winning has been achieved; and outputting, to the prize awarding unit 620, a payout signal which is based on the payout amount. The prize awarding unit 620 has a function of paying out a gaming value to the user. Though not shown, the outputted contents by each of the above processing units may be suitably transmitted to the server 10 connected via a communication line.

In addition to the above, the terminal device 1 includes an increase amount determining unit 640 and a game data request unit 641, an accumulated value acquisition unit 642, a server update period changing unit 643, and a server update request unit 644.

The increase amount determining unit 640 has a function of determining whether a gaming value awarded by the prize awarding unit 620 during the event is not smaller than a predetermined threshold. The game data request unit 641 has a function of requesting the server 10 to send game data of event information when the increase amount determining unit 640 determines that the gaming value awarded by the prize awarding unit 620 is equal to or larger than the predetermined threshold.

The accumulated value acquisition unit 642 has a function of acquiring the accumulated gaming value awarded by the prize awarding unit 620 during the event. The server update period changing unit 643 has a function of changing a server update period based on the accumulated gaming value acquired by the accumulated value acquisition unit 642. The larger the accumulated gaming value is, the shorter the server update period is changed. The server update request unit 644 has a function of sending update information to the server based on the server update period determined by the server update period changing unit 643 during the event.

(Slot Game: Game Contents)

As the slot game, the terminal device 1 has two game modes, namely the base game mode and the bonus game mode. The base game mode is a game state during the normal game, whereas the bonus game mode is equivalent to a game state in the free game. The terminal device 1 shifts to the bonus game mode when the unit game is run in the base game mode and a bonus trigger condition is satisfied in the base game mode. The trigger of the bonus game is, for example, a condition in which three or more bonus symbols appear (are rearranged). The trigger of the bonus game may be another condition.

(Slot Game: Game Contents: Base Game Mode)

The base game mode is specifically described. In the game area displayed on the display 2 (see FIG. 1), symbols for the slot game are rearrangeable on the video reels with three rows and six columns. In a betting process, a bet amount is selected by the user. The bet amount is, for example, selected from numbers such as 1, 2, 3, 5, and 10 by operating the bet button, or an input of a desirable number may be enabled. The resource generated by accumulating parts of bet amounts is termed jackpot.

Thereafter, in the game area, as the symbols are rearranged by varying (scroll-moving) and stopping (scroll-stop) the video reels, whether winning is achieved is determined. Then win determination is performed based on the state of the rearranged symbols. For example, a bonus game trigger is established when three or more bonus symbols are rearranged in the game area.

(Slot Game: Game Contents: Bonus Game Mode)

The base game mode shifts to the bonus game mode when the trigger condition of the bonus game is established, and a free game process is executed, to begin with.

In the free game process, free game reel strips used in the free game are determined, and a predetermined number of times of execution of the free game is set. The reel strips for the free game and the number of times of execution of the free game may be randomly chosen from plural selected options.

As the free game is run, win determination is executed. This win determination may be identical with the win determination in the base game. For example, when three or more bonus symbols appear in the game area again, a retrigger condition of the bonus game (free game) is established, and the number of times of execution of the free game is increased.

Thereafter, whether the free game ends is determined. If the remaining number of times of execution of the free game is not zero, the free game is run for the remaining number of times.

(Event)

The event will be specifically described with reference to the display screen displayed on the display 2 of the terminal device 1.

Figure 4:
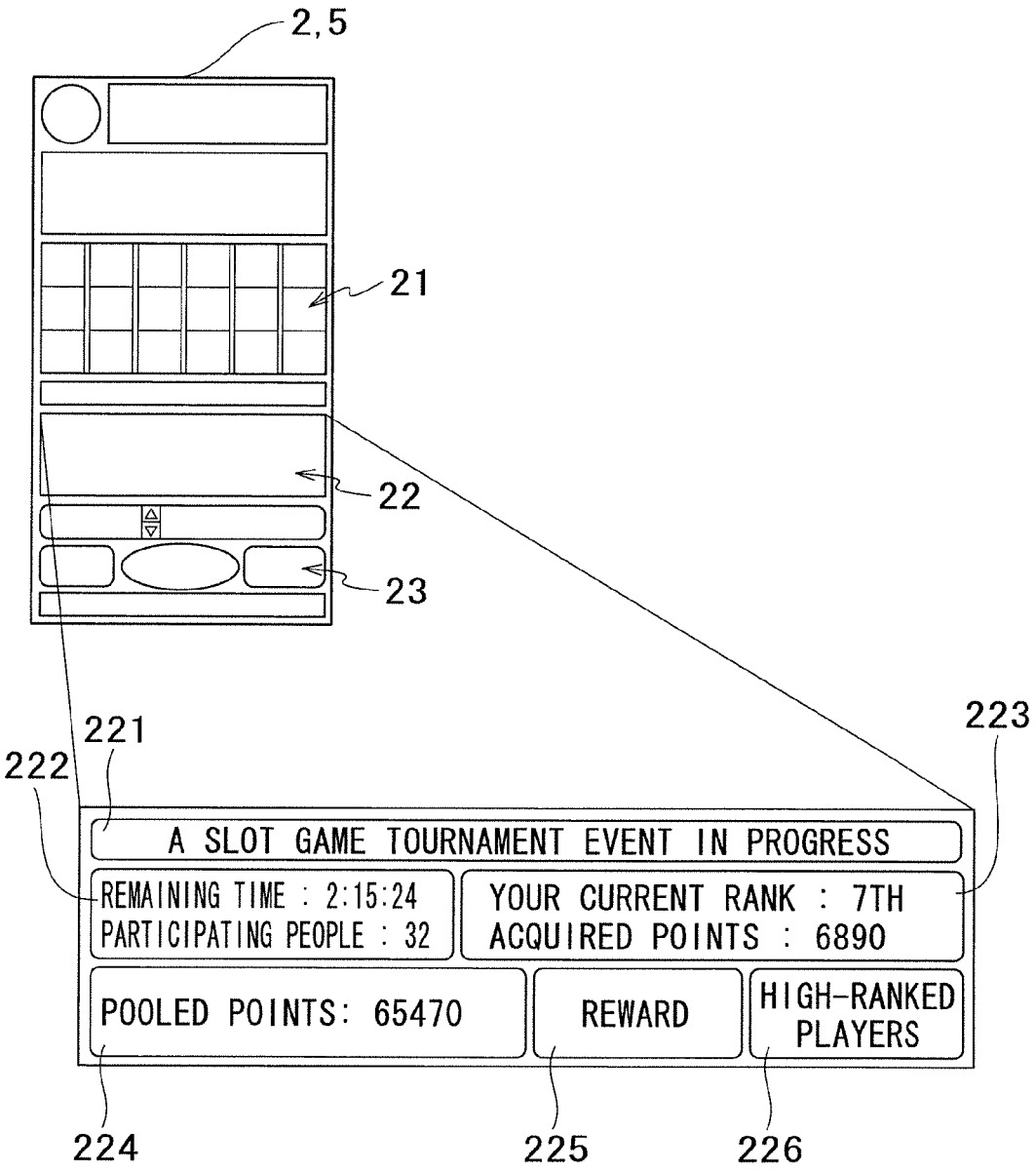
FIG. 4 shows an example of a display screen in an event.

As shown in FIG. 4, the display 2 of the terminal device 1 has a game area 21, an event information display area 22, and a game operation area 23. The game area 21 is an area where video reels are varied (scrolled) and stopped (scroll stop). In other words, symbols are rearranged in the game area 21. The game operation area 23 is an area where objects for operating the slot game are provided. The user is able to determine a bet amount of a gaming value, to start the unit game, and so on, by performing touch input to each object in the game operation area 23.

The event information display area 22 is an area in which event information is displayed during the event. In the event information display area 22, an event name display area 221, an event condition display area 222, a rank display area 223, a pooled point display area 224, a reward button 225, and a high rank button 226 are provided. The event information display area 22 is not displayed when the event is not held.

A name for identifying the currently-held event is displayed in the event name display area 221. For example, when plural events are simultaneously held, each user is able to identify in which event the user participates. The remaining time of the event and the number of people in the group in which the user participates in the event are displayed in the event condition display area 222.

The rank of the user in the event is displayed in the rank display area 223. The rank is determined by the total points calculated based on the gaming value acquired in the slot game during the event. For example, a predetermined ratio of the gaming value acquired in the slot game may be used as the points, or a predetermined ratio of a value calculated by subtracting the gaming value betted in the slot game from the gaming value acquired in the slot game may be used as the points.

In the pooled point display area 224, a predetermined ratio of the gaming values betted by all users in the same group during the event is displayed as pooled points. The pooled points at the end of the event are distributed to the users in the group as gaming values, after the event. The distributed points correspond to the rank of each user. The predetermined ratio for calculating the points may be identical with or different from the predetermined ratio for calculating the pooled points.

The reward button 225 is an object for displaying another window which shows the reward distributed after the end of the event. This window is displayed as the user touches the button. For example, for each rank, which percent of the pooled points is awarded in the form of a gaming value is shown in the window. For example, as the reward, 50% of the pooled points is awarded for the 1st place, 25% is awarded for the 2nd place, 15% is awarded for the 3rd place, 5% is awarded for the 4th place, 5% is awarded for the 5th place, and 0% is awarded for the 6th and subsequent places.

The number of people capable of participating in the group may be changeable depending on the event or the attendance of the event, and the pooled points for the reward may be changed in accordance with the number of people capable of participating in the group. For example, the pooled points for the reward are distributed as above when the number of people participating in the group is 25 or less, and when the number of people participating in the group is 26 to 50, the reward is distributed such that 35% of the pooled points is awarded for the 1st place, 15% is awarded for the 2nd place, 10% is awarded for the 3rd place, 8% is awarded for the 4th place, 7% is awarded for the 5th place, 5% is awarded for the 6th to 10th places, and 0% is awarded for the 11th and subsequent places.

The high rank button 226 is an object for displaying another window in which currently highly-ranked users during the event are shown. The window is displayed as the user touches the button. For example, the user name and the acquired points of each of the current 1st to 3rd users are shown in the window. The user ranks and the acquired points shown in the rank display area 223 may be displayed in the window, too. This allows each user to easily understand the difference between each user and the highly-ranked users.

(Data Table)

The following describes data tables stored in the terminal device 1.

The terminal device 1 stores a terminal event information table shown in FIG. 5. The terminal event information table has an event column, a status column, an acquired point column, a participating number column, a current rank column, a pooled point column, a reward information column, and a high rank information column. The event column stores identification information for identifying events. The status column stores information indicating whether an event is being held. The acquired point column stores points (predetermined ratio of acquired gaming value) acquired as a result of execution of the slot game on the terminal device 1. Data in which information in the event column and information in the acquired point column are associated with user identification information is sent to the server 10 as update information. The server 10 is provided with a database including information of the terminal event information table of all terminal devices 1. Each time the update information is sent from the terminal device 1, the server 10 updates the acquired points of the corresponding user, and when the user is a new user in the event, the server 10 adds a new column and distributes the user to a group. Based on the updated acquired points, the rank and pooled points of the user and the high ranks are updated, and the updated information is sent to the terminal device 1 as event information.

Information is stored in the participating number column, the current rank column, the pooled point column, the reward information column, and the high rank information column based on the event information supplied from the server 10. Information is displayed on the event information display area 22 based on this event information.

The terminal device 1 stores an update threshold table shown in FIG. 6. The update threshold table is a table by which the intervals of sending the update information from the terminal device 1 to the server 10 during the event are set in accordance with the gaming value accumulated by the terminal device 1. The update threshold table includes an accumulated value range column and an update request interval column. The terminal device 1 determines in which range the accumulated gaming value falls, and sends the update information at update request intervals corresponding to the determination result.

(Terminal Device 1: Operations)

The following will describe a game program executed by the CPU 101 of the terminal device 1.

(Event Information Request Process)

Figure 7:
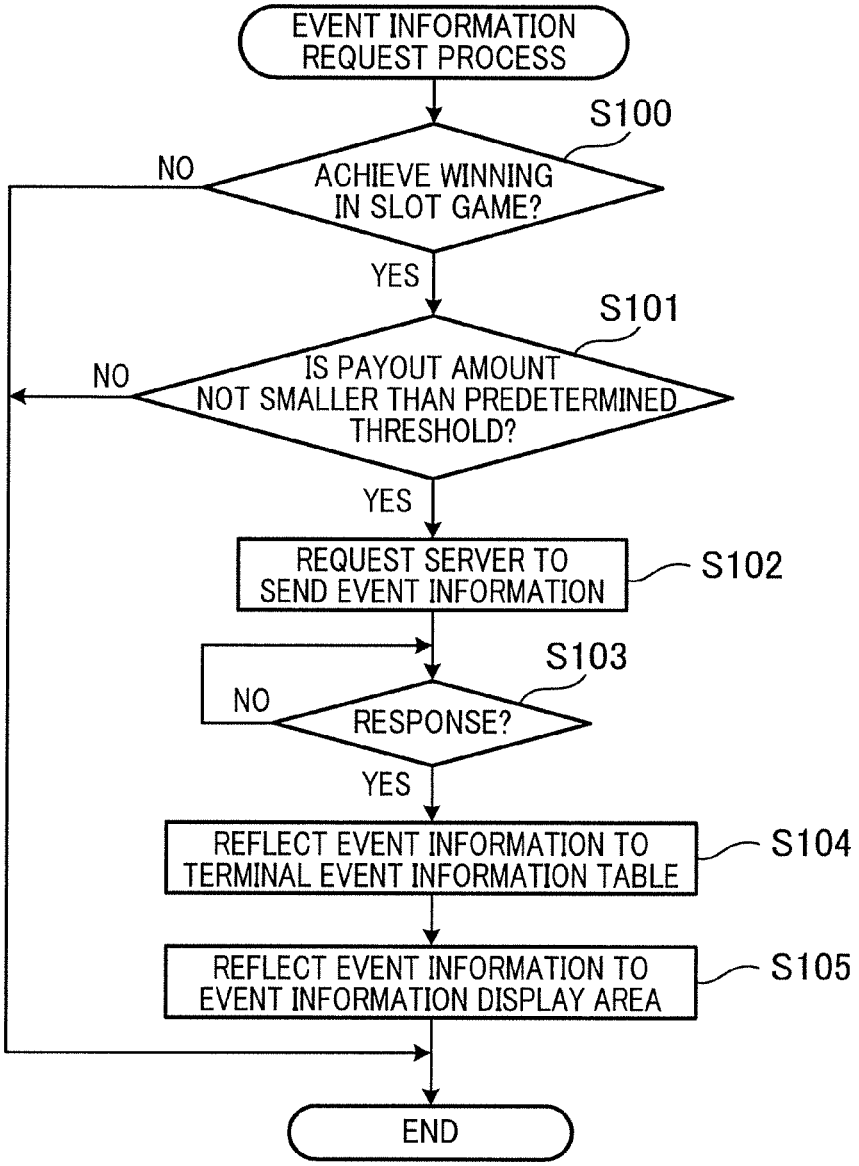
FIG. 7 is a flowchart of an event information request process.

The following describes an event information request process with reference to FIG. 7. The event information request process is executed each time the unit game of the slot game ends.

To begin with, the CPU 101 determines whether a winning is achieved in the slot game (S100). When no winning is achieved in the slot game (NO in S100), the CPU 101 terminates the routine. Meanwhile, when a winning is achieved in the slot game (YES in S100), the CPU 101 determines whether a gaming value which is the payout amount is not smaller than a predetermined threshold (S101). When the gaming value which is the payout amount is smaller than the predetermined threshold (NO in S101), the CPU 101 terminates the routine.

Meanwhile, when the gaming value which is the payout amount is equal to or larger than the predetermined threshold, a request is made to the server 10 to send event information (S102). Thereafter, the CPU 101 determines if the event information has been sent from the server 10 (S103). If the event information has not been sent (S103: NO), the CPU 101 repeats the step S103 and waits for a response from the server 10.

If the event information has been sent from the server 10 (YES in S103), the CPU 101 reflects the event information to the terminal event information table (see FIG. 5) (S104). Furthermore, the CPU 101 reflects the event information to each area in the event information display area 22 (S105), and the CPU 101 terminates the routine.

(Update Request Process)

Figure 8:
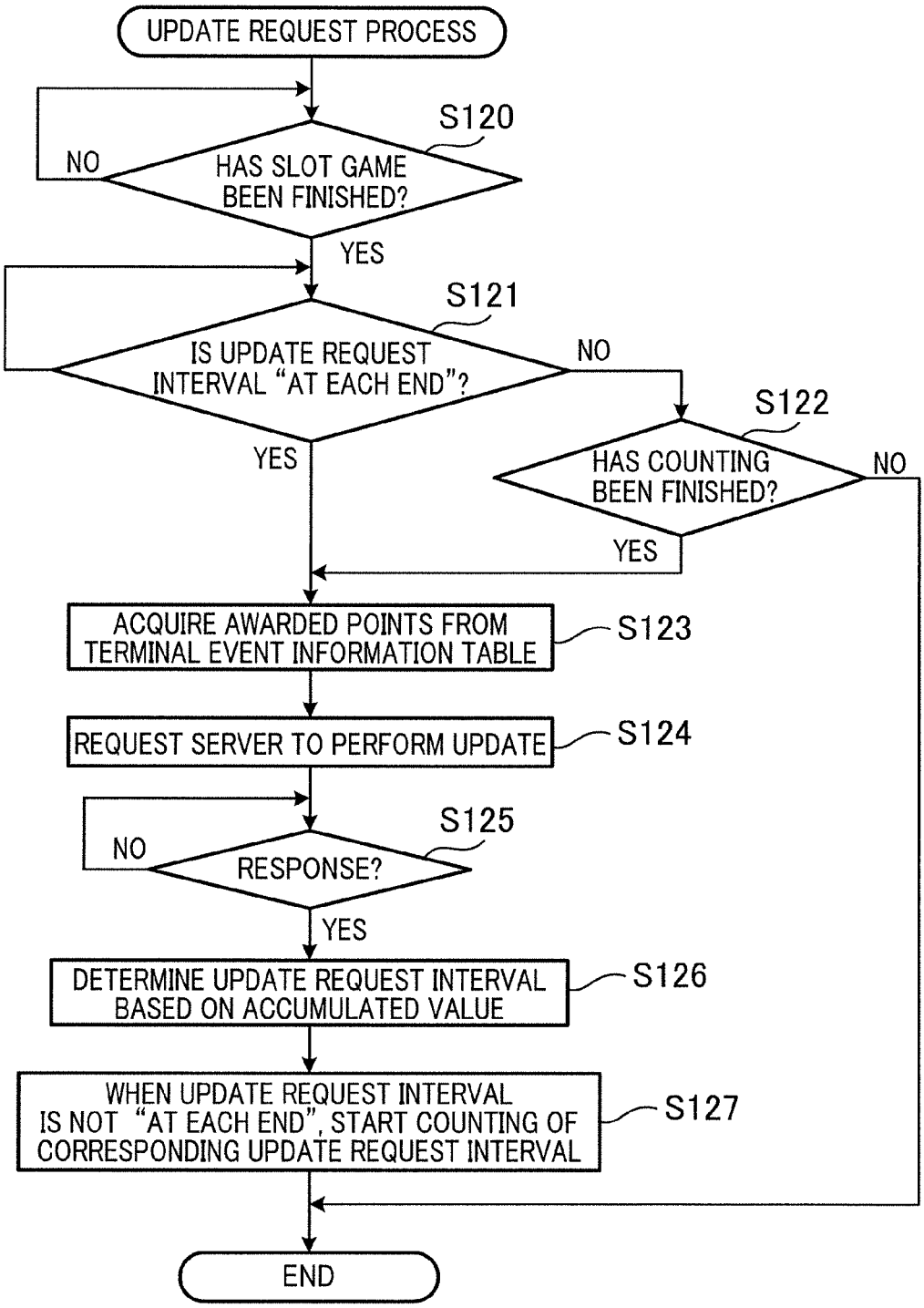
FIG. 8 is a flowchart of an update request process.

The following describes an update request process with reference to FIG. 8. The update request process is executed each time the unit game of the slot game ends.

To begin with, the CPU 101 determines whether the slot game has been finished (S120). If the slot game has not been finished (NO in S120), the CPU 101 repeats the step S120 and waits for the finish of the slot game. Meanwhile, if the slot game has been finished (YES in S120), the CPU 101 determines whether an update request interval is "at each end" (S121). If the update request interval is not "at each end" (NO in S121), the CPU 101 determines whether the counting has been finished (S122). When the counting has not been finished (NO in S122), the CPU 101 terminates the routine.

If the update request interval is "at each end" (YES in S121) or the counting has been finished (YES in S122), the CPU 101 acquires awarded points from the terminal event information table (see FIG. 5) (S123). The CPU 101 then sends, to the server 10, update information including event identification information, user identification information, etc., and requests the server 10 to perform update (S124).

The CPU 101 determines whether there is a response from the server 10 indicating that the update has been finished (S125). If there is no response (NO in S125), the CPU 101 repeats the step S125 and waits for a response. If there is a response (YES in S125), the CPU 101 determines the update request interval with reference to the update threshold table (see FIG. 6) and based on the accumulated gaming value (S126). If the determined update request interval is not "at each end", the CPU 101 starts the counting of the determined update request interval (S127) and terminates the routine.

As described above, the terminal device 1 is programmed to execute a process of requesting the update of the game data at predetermined intervals and a process of shortening the predetermined interval as the accumulated gaming value is increased. With this arrangement, the larger the accumulated gaming value owned by the user is, the more frequently the game data of the server 10 is updated. When the accumulated gaming value is large, the game state is likely to be changed in the upcoming game play. For this reason, the game data is properly updated by preferentially updating the game data of such a user.

(Server 10: Operations)

The following will describe a game program executed by the CPU 1101 of the terminal device 1.

(Event Information Response Process)

Figure 9:
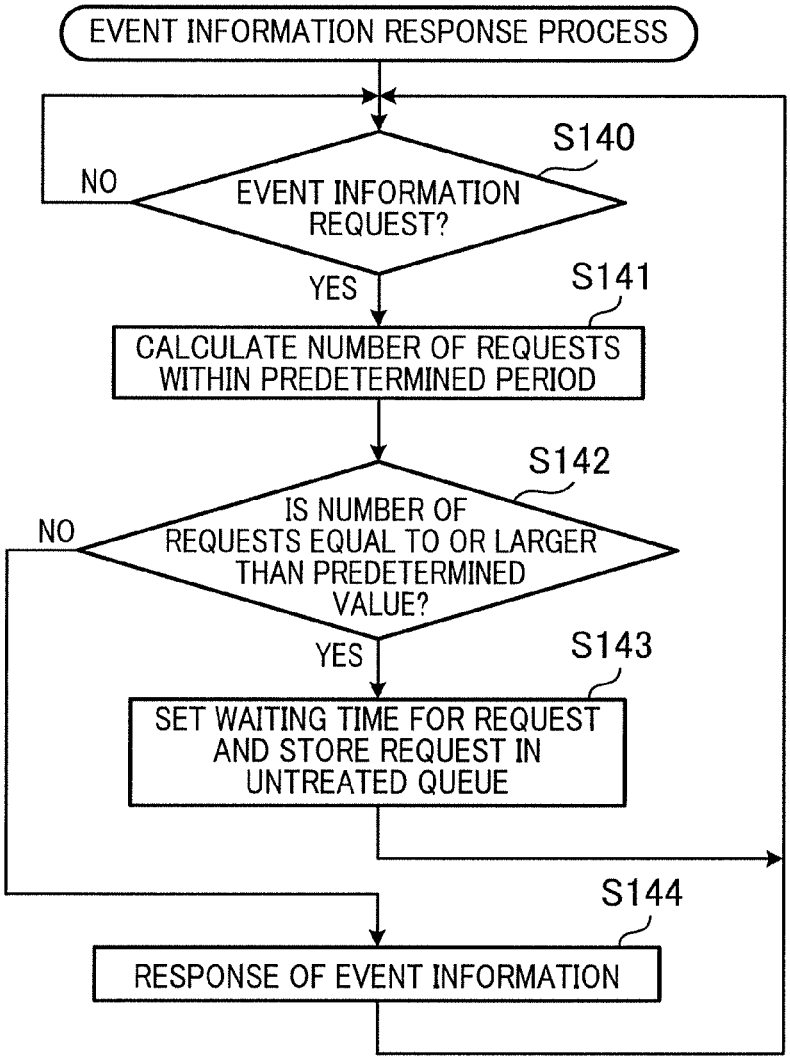
FIG. 9 is a flowchart of an event information response process.

The following describes an event information response process with reference to FIG. 9. The event information response process is executed when the terminal device 1 requests to send event information.

To begin with, the CPU 1101 determines whether an event information request has been sent from the terminal device 1 (S140). In this regard, the CPU 1101 manages event information requests from the terminal devices 1 by classifying them into an untreated queue, a waiting queue, and a responded queue. The CPU 1101 serially responds to event information requests in the untreated queue. In the step S140, when the waiting time of an event information request in the waiting queue has lapsed, the CPU 1101 moves such an event information request to the untreated queue. In other words, in the step S140, the CPU 1101 moves an event information request with the lapsed waiting time from the waiting queue to the untreated queue, and then determines where there is an event information request in the untreated queue.

When there is no event information request from the terminal device 1 (NO in S140), the CPU 1101 repeatedly executes the step S140 and waits for a request from the terminal device 1. Meanwhile, if there is an event information request from the terminal device 1 (YES in S140), the CPU 1101 calculates the number of requests within a predetermined period up to the present time (S141). In other words, the CPU 1101 samples event information requests to which responses were made within the predetermined period, from the event information requests in the responded queue.

The CPU 1101 then determines whether the number of requests within the predetermined period is not smaller than a predetermined number (S142). When the number of requests within the predetermined period is not smaller than the predetermined number (YES in S142), the CPU 1101 sets a waiting time for each event information request and stores the request in the untreated queue (S143), and goes back to the step S140. When the waiting time of that event information request has already elapsed, the event information request may be responded as an exception. When the number of requests within the predetermined period is smaller than the predetermined number (NO in S142), the CPU 1101 responds to the event information request (S144) and goes back to the step S140.

In this way, the server 10 is arranged to change a timing to respond to a request of sending game data after a predetermined period elapses, in accordance with the number of requests of sending game data from plural terminal devices 1 within the predetermined period. With this arrangement, when the number of requests of sending game data is large, a timing to respond to a terminal device 1 is delayed on the server 10 side, with the result that the load on the server 10 is reduced.

(Overview of Invention)

The game system 100 of the present embodiment is a game system including the terminal devices 1 on each of which a game is playable and the server 10 which is connected to the terminal devices 1 in a communicable manner and manages game data used in a game played on the terminal devices 1, and each of the terminal devices 1 includes a controller (such as the CPU 101) and is programmed to execute a process of executing the game in which the accumulable gaming value is increased or decreased in accordance with a result of the game and a process of requesting the server 10 to send managed game data when the amount of increase of the gaming value as a result of the game is equal to or larger than a predetermined threshold.

According to the arrangement above, the terminal device 1 requests the server 10 to send game data when the gaming value increases at least by a predetermined threshold as a result of the executed game. With this arrangement, even when the game is executed on the terminal device 1, a request of sending game data is not made until a gaming value equal to or larger than the predetermined threshold is acquired. As a result, even when the game is executed on the plural terminal devices 1, it is less likely that many terminal devices 1 request the sending of game data at the same time, and hence access concentration to the server 10 is avoided and necessary information can be acquired at a suitable timing.

In the game system 100 of the present embodiment, the controller (e.g., the CPU 101) is programmed to further execute a process of requesting the update of the game data at predetermined intervals and a process of shortening the predetermined interval as the accumulated gaming value is increased.

According to the arrangement above, the process of requesting the update of the game data is executed at predetermined intervals, and the predetermined interval is shortened as the amount of the gaming value accumulated in the terminal device 1 is increased. With this arrangement, the larger the accumulated gaming value owned by the user is, the more frequently the game data of the server 10 is updated. When the accumulated gaming value is large, the game state is likely to be changed in the upcoming game play. For this reason, the game data is properly updated by preferentially updating the game data of such a user.

In the game system 100 of the present embodiment, the server 10 is arranged to change a timing to respond to a request of sending game data after a predetermined period elapses, in accordance with the number of requests of sending game data from plural terminal devices 1 within the predetermined period.

According to this arrangement, a timing to respond to a request of sending game data after a predetermined period elapses is changed in accordance with the number of requests of sending game data within the predetermined period. With this arrangement, when the number of requests of sending game data is large, a timing to respond to a terminal device 1 is deleted on the server 10 side, with the result that the load on the server 10 is reduced.

A method of controlling the game system 100 of the present embodiment is a method of controlling the game system 100 including the terminal devices 1 on each of which a game is playable and the server 10 which is connected to the terminal devices 1 in a communicable manner and manages game data used in a game played on the terminal devices 1, and includes a process in which each of the terminal devices 1 executes the game in which the accumulable gaming value is increased or decreased in accordance with a result and a process in which each of the terminal devices 1 requests the server 10 to send managed game data when the amount of increase of the gaming value as a result of the game is equal to or larger than a predetermined threshold.

According to the arrangement above, the terminal device 1 requests the server 10 to send game data when the gaming value increases at least by a predetermined threshold as a result of the executed game. With this arrangement, even when the game is executed on the terminal device 1, a request of sending game data is not made until a gaming value equal to or larger than the predetermined threshold is acquired. As a result, even when the game is executed on the plural terminal devices 1, it is less likely that many terminal devices 1 request the sending of game data at the same time, and hence access concentration to the server 10 is avoided and necessary information can be acquired at a suitable timing.

The flash memory 104 (recording medium) of the present embodiment is a non-transitory computer readable medium storing a game program, and the game program causes a computer (terminal device 1) including a processor and a memory to execute a process of executing the game in which the accumulable gaming value is increased or decreased in accordance with a result of the game and a process of requesting the server 10 to send managed game data when the amount of increase of the gaming value as a result of the game is equal to or larger than a predetermined threshold.

According to the arrangement above, the computer requests the server 10 to send game data when the gaming value increases at least by a predetermined threshold as a result of the executed game. With this arrangement, even when the game is executed on the computer, a request of sending game data is not made until a gaming value equal to or larger than the predetermined threshold is acquired. As a result, even when the game is executed on plural computers, it is less likely that many terminal devices 1 request the sending of game data at the same time, and hence access concentration to the server 10 is avoided and necessary information can be acquired at a suitable timing.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

Further, the detailed description above is mainly focused on characteristics of the present invention to for the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the present invention described in this specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A network game system comprising:

a plurality of terminal devices upon which an independent base game is separately playable on each of the plurality of terminal devices and a common event is shareable amongst the plurality of terminal devices;

a server in communication with each of the plurality of terminal devices via communications network, the server configured to receive and manage game data corresponding to the independent base game separately playable at each of the plurality of terminal devices as well as the common event shareable amongst the plurality of terminal devices;

wherein, each of the terminal devices includes a controller and a non-transitory computer readable storage medium, the controller programmed to execute the processes of:

executing the independent base game in which a gaming value is increased or decreased in accordance with a result of the independent base game; and requesting the server to send the game data managed by the server and corresponding to the common event via the communications network, when an accumulated amount of the gaming value as a result of the independent base game is equal to or larger than a predetermined threshold;

wherein, each of the terminal devices is configured to separately request updated game data managed by the server and corresponding to the common event at one of incrementally smaller predetermined intervals based on the accumulated gaming value associated with a respective terminal device.

2. The game system according to claim 1, wherein, the controller is programmed to further execute the processes of:

requesting the updated game data at the one of incrementally smaller predetermined intervals; and shortening each of the predetermined intervals as the accumulated gaming value associated with the respective terminal device is increased.

3. The game system according to claim 1, wherein, the server changes a timing to respond to a request of sending the game data after a predetermined period elapses, in accordance with the number of requests of sending the game data from the terminal devices within the predetermined period.

4. The game system of claim 1, wherein the predetermined intervals at which the updated game data is requested is different between each of the terminal devices.

5. The game system of claim 1, wherein each of the terminal devices connected to the server simultaneously execute an event game; and wherein, a first terminal device having a larger accumulated gaming value during the event game requests updated game data at a shorter interval as compared to a second terminal device having a lower accumulated gaming value during the event game.

6. The game system of claim 5, wherein the game data and the updated game data includes information corresponding to a ranking of a user executing the event game.

7. The game system of claim 1, wherein the request to the server is not made when the accumulated gaming value is less than a preset threshold.

8. The game system of claim 1, wherein the game data and the updated game data includes information corresponding to at least a ranking of the user.

9. The network game system of claim 1, wherein the non-transitory computer readable storage medium of each terminal device stores an update threshold table including information corresponding to a plurality of preset accumulated gaming value ranges and respective incrementally smaller predetermined update request time intervals.

10. The network game system of claim 1, wherein the non-transitory computer readable storage medium of each terminal device stores an update threshold table including information corresponding to a plurality of preset accumulated gaming value ranges and respective incrementally smaller predetermined update request time intervals; and wherein, the controller of each gaming terminal, references its respective update threshold table to:

determine which of the plurality of preset accumulated gaming value ranges of the update threshold table the accumulated gaming value is greater than or equal to;

determine the respective incrementally smaller predetermined update request time interval based on the accumulated gaming value; and, based on the determined update request time interval, transmit a respective update request to the server.

11. A method of controlling a networked game system including:

a plurality of terminal devices upon which an independent base game is separately playable on each of the plurality of terminal devices and a common event is shareable amongst the plurality of terminal devices;

a server in communication with each of the plurality of terminal devices via a communications network, the server configured to receive and manage game data corresponding to the independent base game separately playable at each of the plurality of terminal devices as well as the common event shareable amongst the plurality of terminal devices;

wherein, each of the terminal devices includes a controller and a non-transitory computer readable storage medium; and, wherein, the method comprising the steps of:

causing each of the terminal devices to execute the independent base game separately playable at each of the plurality of terminal devices in which a gaming value is increased or decreased in accordance with a result of the independent base game; and causing each of the terminal devices to request the server to send the game data managed by the server and corresponding to the common event via the communications network, when an accumulated amount of the gaming value as a result of the independent base game is equal to or larger than a predetermined threshold, wherein, each of the terminal devices is configured to separately request updated game data managed by the server and corresponding to the common event at one of smaller predetermined intervals based on the accumulated gaming value associated with a respective terminal device.

12. The method of claim 11, further comprising requesting the updated game data at the one of incrementally smaller predetermined intervals and shortening the predetermined intervals as the accumulated gaming value associated with the terminal device is increased.

13. The method of claim 11, wherein the predetermined intervals at which the updated game data is requested is different between each of the terminal devices.

14. The method of claim 11, wherein each of the terminal devices connected to the server simultaneously execute an event game; and wherein, a first terminal device having a larger accumulated gaming value during the event game requests updated game data at a shorter interval as compared to a second terminal device having a lower accumulated gaming value during the event game.

15. The game system of claim 14, wherein the game data and the updated game data include information corresponding to a ranking of a user executing the event game.

16. The game system of claim 11, wherein the request to the server is not made when the accumulated gaming value is less than a preset threshold.

17. The game system of claim 11, wherein the game data and the updated game data include information corresponding to at least a ranking of the user.

18. A non-transitory computer readable medium storing a game program, the game program causing a computer including a processor and a memory to execute the processes of:

executing an independent base game in which a gaming value is increased or decreased in accordance with a result of the independent base game; and requesting a server connected to the computer via a communications network to send game data managed by the server and corresponding to a common event when an accumulated amount of the gaming value as a result of the independent game is equal to or larger than a predetermined threshold;

wherein updated game data managed by the server and corresponding to the common event is requested at one of a plurality of incrementally smaller predetermined intervals based on the accumulated gaming value associated with the computer.

19. A non-transitory computer readable medium storing a game program of claim 18, wherein the updated game data is requested at the predetermined intervals and the predetermined interval is shortened as the accumulated gaming value associated with the terminal device is increased.

20. The non-transitory computer readable medium of claim 18, wherein the predetermined intervals at which the updated game data is requested is different between a plurality of computers.

21. The non-transitory computer readable medium of claim 18, wherein a plurality of terminal devices each including a computer are each connected to the server and are each programmed to simultaneously execute an event game; and wherein, a first terminal device having a larger accumulated gaming value during the event game requests updated game data at a shorter interval as compared to a second terminal device having a lower accumulated gaming value during the event game.

22. The non-transitory computer readable medium of claim 18, wherein the request to the server is not made when the accumulated gaming value is less than a preset threshold.

* * * * *